US006315385B1

(12) United States Patent
Te

(10) Patent No.: US 6,315,385 B1
(45) Date of Patent: Nov. 13, 2001

(54) SELF-LOCATING ORIFICE PLATE CONSTRUCTION FOR THERMAL INK JET PRINTHEADS

(75) Inventor: Bun Chay Te, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/628,383

(22) Filed: Aug. 1, 2000

(51) Int. Cl.[7] ..... B41J 2/14
(52) U.S. Cl. ..... 347/20; 347/40
(58) Field of Search ..... 347/20, 40, 47, 347/48, 63, 65; 29/890.1, 25.35

(56) References Cited

U.S. PATENT DOCUMENTS 5,774,149 * 6/1998 Shimizu ..... 347/63
5,971,522 * 10/1999 Ono et al. ..... 347/40

FOREIGN PATENT DOCUMENTS 0641659 1/1998 (EP) .

* cited by examiner

*Primary Examiner*—Anh T. N. Vo

(57) ABSTRACT

An improved printhead for easier manufacturing is disclosed. The printhead has a non-uniformly thick electroformed orifice plate having orifices electroformed therethrough. This electroformed orifice plate has a thin area and a thick area. The thick area defines projections from the thin area. The printhead also has a printhead die that includes transducers on a substrate. Each transducer matches to one of the orifices of the orifice plate. The printhead also has a barrier layer on the substrate that is developed to define ink channels and ink chambers for delivering ink to the transducers. The barrier layer is also developed to define a locator. When the orifice plate is attached to the printhead die during assembly, the projections on the orifice plate mesh with the locator on the barrier layer to substantially hold the orifice plate and the printhead die in place to align each orifice to a corresponding transducer.

9 Claims, 4 Drawing Sheets

SELF-LOCATING ORIFICE PLATE CONSTRUCTION FOR THERMAL INK JET PRINTHEADS

FIELD OF THE INVENTION

This invention relates to thermal ink jet pens, more particularly, to an improved construction of the printheads for easier manufacturing.

BACKGROUND

A prior art ink-jet printer typically includes a printing cartridge or pen in which small droplets of ink are formed and ejected toward a printing medium. Such pens include printheads with orifice plates having very small orifices or nozzles through which the ink droplets are ejected. Adjacent to the orifices inside the printhead are ink chambers, where ink is stored prior to ejection. Ink is delivered to the ink chambers through ink channels. Each orifice and associated structure which defines the ink chamber and ink channel is commonly known as a firing element. A manifold in the pen connects the firing elements to an ink supply. The ink supply may be, for example, contained in a reservoir part of the pen.

Ejection of an ink droplet through an orifice may be accomplished by quickly heating a volume of ink within the adjacent ink chamber. The rapid expansion of ink vapor forces a drop of ink through the orifice. This process is called "firing." The ink in the chamber may be heated with a transducer such as a resistor that is aligned adjacent to the orifice. If the orifice is not properly aligned with the transducer, the print quality of the pen can be adversely affected.

The current construction of orifice plates and method of attaching the orifice plates to printhead dies are prone to result in printheads whose orifice pates are misaligned. FIGS. 1 is a cross-sectional view of a prior art mandrel 2. This mandrel has a metallic layer 4 deposited on a substrate 6. The metallic layer 4 is appropriately photolithographically patterned and etched to provide a molding surface for electroforming an orifice plate 8. Holes in the metallic layer 4 have surfaces that electroform orifices 10 in the orifice plate 8. The orifice plate 8 that is formed by using such a prior art mandrel 2 is substantially uniformly thick and has a substantially flat surface 12. During the manufacturing of a printhead (not shown), it is this surface 12 of the orifice plate 8 that is attached to a barrier layer on a printhead die (not shown).

To increase manufacturing productivity, many such orifice plates are formed as a single sheet on an appropriate mandrel. After being electroformed to a predetermined thickness, the orifice plates are singulated for attaching individually to a printhead die. A machine picks and places each orifice plate over a corresponding printhead die on a wafer containing many such dies. The wafer and attached orifice plates are put through a "stake and bake" process to cause the orifice plates to adhere to the printhead dies. After the "stake and bake" process, each printhead consisting of a printhead die and an orifice plate is singulated using dice sawing. Each complete pair of orifice plate and printhead die is then ready for attaching to a pen body to complete the fabrication of an ink-jet pen.

During the "stake and bake" process, pressure is applied to the orifice plate to hold it in place over the printhead die. This pressure has the tendency to cause the orifice plate to shift and as a result become misaligned. Another recurring problem is adhesion of the orifice plate to the printhead die. Delamination can occur from residual stresses.

It is therefore desirable to have an orifice plate that ameliorates the misalignment and delamination problems associated with prior art electroformed orifice plates.

EP 0641 659 discloses a means of attaching an orifice plate made of tape automated bonding (TAB) circuit or flexible circuit on a printhead die so that orifices on the orifice plate are aligned over transducers on the printhead die. The alignment is achieved by copper traces on the TAB or flexible circuit mating with correspondingly etched channels in a barrier layer on the printhead die. With such alignment, only rough alignment is required when attaching the orifice plate to the printhead die. As the two are brought into contact, they tend to lock in place.

Such an alignment method works for a flexible circuit orifice plate but cannot be easily and economically duplicated for metal orifice plates. Firstly, copper traces cannot be run on metal orifice plates. With prior art methods of electroforming metal orifice plates, it is impossible for similar traces to be created on the metal orifice plates.

There is also a difference between the manufacturing process of a pen with a flexible circuit orifice plate and one with a metal orifice plate. For the former, the flexible circuit orifice plate is attached only after the printhead die is attached to a pen body. At such a stage, if there is any pen failure due to misalignment of the flexible circuit orifice plate, the whole pen is discarded. For the case of a metal orifice plate, the orifice plate is attached to the printhead die before the combination is attached to a pen body. The combination can be tested before attaching to a pen body. Yield loss in the manufacturing of metal orifice plate pens is therefore lower, making manufacturing of such pens preferable to those with flexible circuit orifice plates.

It is therefore advantageous to be able to create an electroformed orifice plate that can be attached to a printhead die so that orifices on the orifice plate are aligned over transducers on the printhead die.

SUMMARY

In one aspect of the present invention, a printhead according to a preferred embodiment has a non-uniformly thick electroformed orifice plate having orifices electroformed therethrough. This electroformed orifice plate has a thin area and a thick area. The thick area defines projections from the thin area. The printhead also has a printhead die that includes transducers on a substrate. Each transducer matches to one of the orifices of the orifice plate. The printhead also has a barrier layer on the substrate that is developed to define ink channels and ink chambers for delivering ink to the transducers. The barrier layer is also developed to define a locator. When the orifice plate is attached to the printhead die during assembly, the projections on the orifice plate mesh with the locator on the barrier layer to substantially hold the orifice plate and the printhead die in place to align each orifice to a corresponding transducer.

In another aspect of the present invention, a method for assembling the above-mentioned thermal ink jet printhead involves applying an appropriate amount of adhesive to one or both of the orifice plate and the barrier layer. Next, the method includes attaching the orifice plate to the printhead die so that the projections on the orifice plate mesh with the locator of the barrier layer to form a printhead and to substantially hold the orifice plate and the printhead die in place to align each orifice with a corresponding transducer. The printhead is finally baked to allow the orifice plate to be bonded to the printhead die.

BRIEF DESCRIPTION OF DRAWINGS

The invention will be better understood with reference to the drawings, in which:

FIG. 2A also shows an orifice plate electroformed thereon.

DETAILED DESCRIPTION OF THE PREFERRED EMBODIMENT

Figure 1:
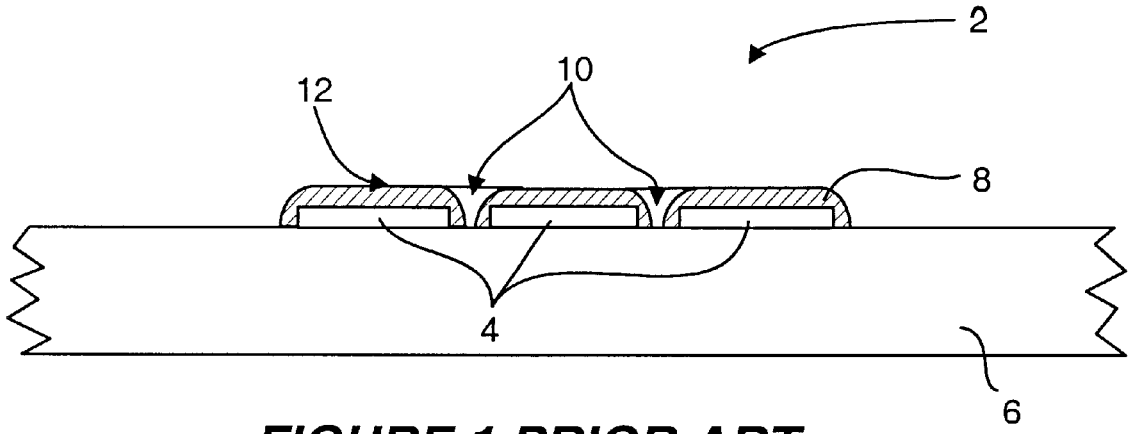
FIGURE 1 PRIOR ART
FIG. 1 is a cross-section view of a prior art mandrel and an orifice plate electroformed thereon.
Figure 2C:
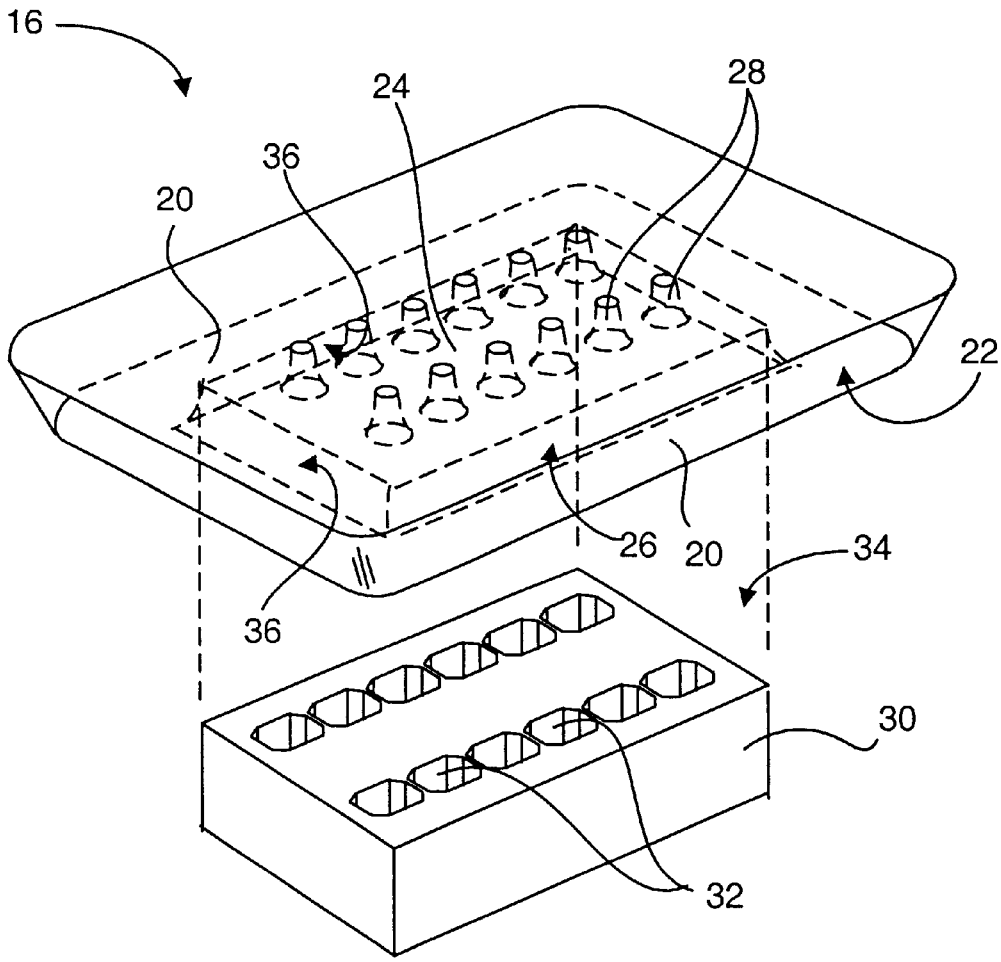
FIG. 2C is an isometric view of the electroformed orifice plate in FIG. 2A shown in a position for attachment to an appropriately shaped barrier layer of a printhead die.
Figure 2A:
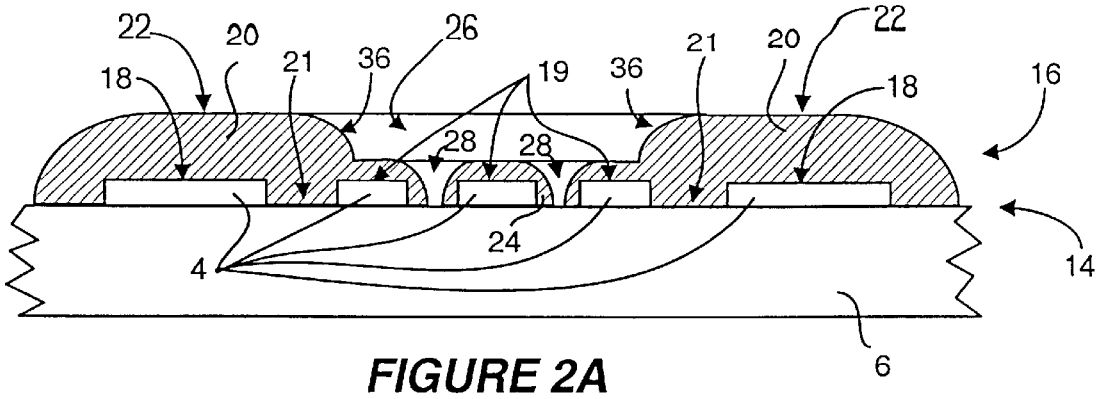
FIG. 2A is a cross-sectional view of a possible mandrel that can be used to electroformed an orifice plate for the present invention.
Figure 2B:
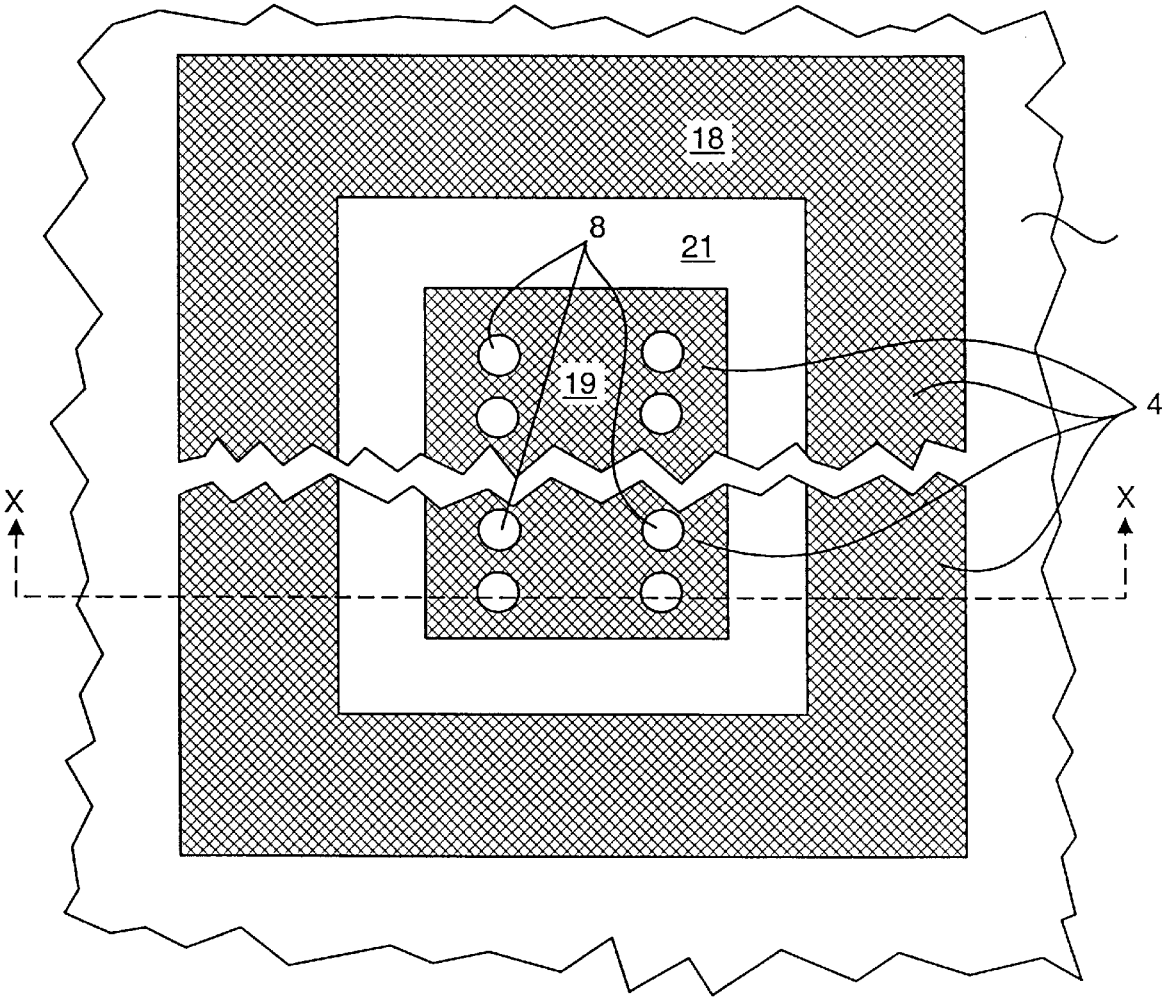
FIG. 2B is a plan view of the mandrel in FIG. 2A without the electroformed orifice plate.

FIG. 2A is a cross-sectional view of a possible mandrel 14 for electroforming an orifice plate 16 for use with the present invention. The mandrel 14 has a conductive thin film or metallic layer 4 deposited on a substrate 6. Examples of substrates are a glass substrate, a plastic substrate or a polished silicon wafer. This metallic layer 4 preferably ranges from 100 angstroms to 200 microns thick. Other thickness ranges are possible. This metallic layer 4 is preferably made up of a layer of chrome beneath a layer of stainless steel. The chrome layer bonds firmly to the substrate 6 and provides a surface that the stainless steel layer can adhere to. However, a single chromium layer will also work.

The etching of the metallic layer 4 of the mandrel 14 defines a first molding surface 18, a second molding surface 19 and a gap 21 between the two surfaces 18,19. The two molding surfaces 18, 19 are electrically isolated. In using the mandrel 14 to electroform an orifice plate 16, electroforming is allowed to commence only on the first molding surface 18. The build-up of metal on the first molding surface 18 will over time bridge the gap 21 between the first and the second molding surfaces 18, 19. When the metal connects the two molding surfaces 18,19, substantial electroforming will also begin on the second molding surface 19.

FIG. 2C shows an isometric view of the orifice plate 16 electroformed using the mandrel 14. The orifice plate 16 has projections 20 that, in this case, define a border 22 surrounding a thinner orifice area 24. The surrounding of the thinner orifice area 24 by the thicker border 22 defines a cavity 26 adjacent the orifice area 24. Orifices 28 are electroformed in the orifice area 28. The projections 20 are a result of the earlier build up of metal on the first molding surface 18. These projections 20 on an orifice plate 16 can be obtained by the appropriate photolithographical patterning and etching of the metallic layer 4 of the mandrel 14. The general steps in the electroforming process are well known to those skilled in the art. The profile of accumulation of metal on the mandrel 14 is also well known. Orifice plates 16 with these projections 20 can be accurately electroformed on a mandrel 14 to a tolerance of about two microns.

FIG. 2C also shows a barrier layer 30 that is used on a printhead die to define ink channels (not shown) and ink chambers 32. This barrier layer 30 is processed using a conventional photolithographic and developing process. This process is highly accurate. Using such a process, the barrier layer 30 is also developed in the shape of a block 34 to serve as a locator 34 to substantially fit into the cavity 26 of the orifice plate 16. The properties of this barrier layer 30 are well known to those skilled in the art.

In the manufacturing of a printhead, an appropriate amount of adhesive is applied on the surface of the barrier layer 30. Next, the orifice plate 16 is placed over the barrier layer 30 as shown in FIG. 2C with the aid of a conventional vision system. The means for allowing the vision system to place the orifice plate 16 on the barrier layer 30 is not shown in FIG. 2C but is well known to those skilled in the art. With the present invention, this vision system need not be as highly accurate as before. With the non-uniformly thick electroformed orifice plate 16, some degree of misalignment in the placing of the orifice plate 16 on the printhead die is tolerable.

During a subsequent stake-and-bake process to bond the orifice plate 16 to the printhead die, pressure is applied to the orifice plate 16 to hold the orifice plate 16 in place over the barrier layer 30. This pressure has the tendency to correct any misalignment in the placement of the orifice plate 16. When the pressure is applied to the orifice plate 16, curved surfaces 36 of the projections 20 on the orifice plate 16 allow the orifice plate 16 to slide on the block of barrier material 34 to self-locate over the block. It should be noted that contact pads (not shown) for carrying control signals to the transducers (not shown) on the printhead die are usually located on the printhead die adjacent such a barrier layer. It is therefore important when the orifice plate 16 is attached to the barrier layer 30 that the orifice plate 16 does not come into contact with the contact pads to cause any short circuits. This condition can be avoided by electroforming the projections 20 and the orifice area 22 to appropriate thicknesses so that the depth of the cavity is less than the barrier layer thickness.

Figure 3A:
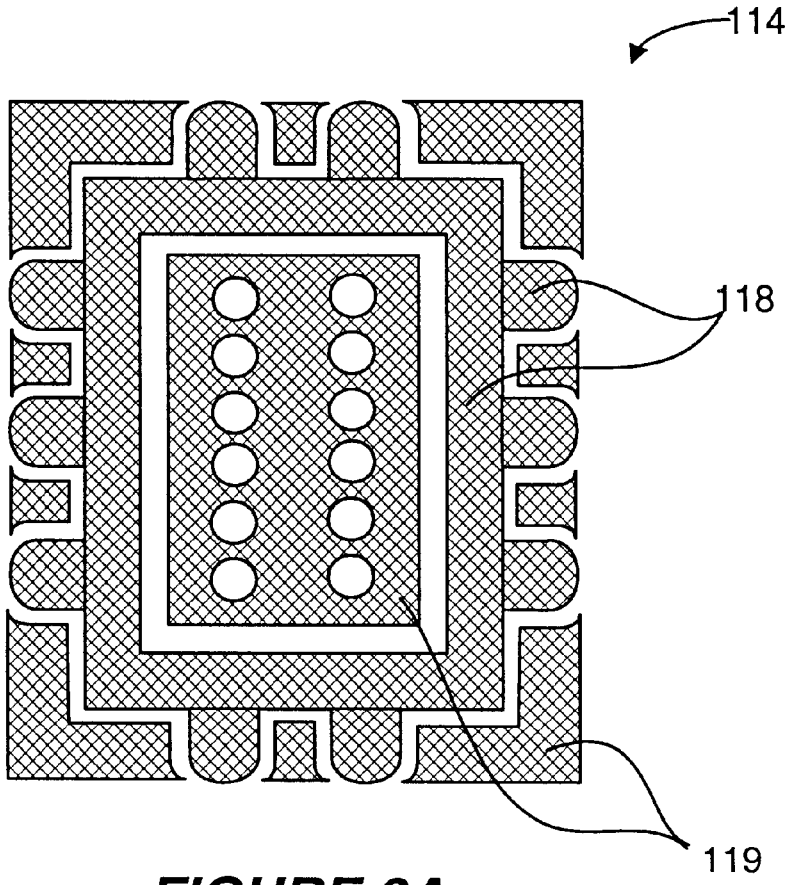
FIG. 3A is a plan view of another possible mandrel that can be used to electroform a different orifice plate for use in the present invention.
Figure 3B:
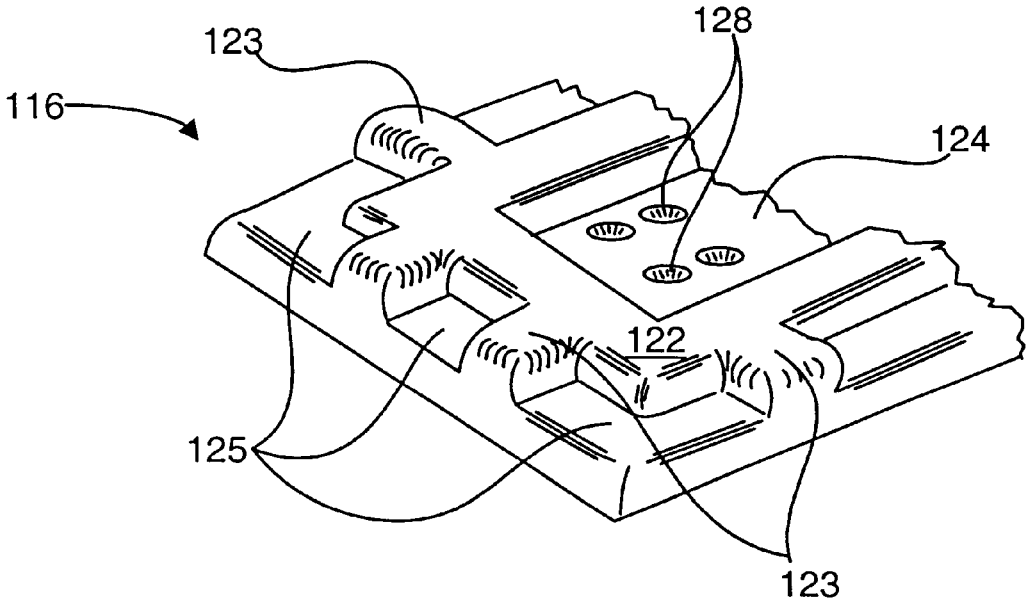
FIG. 3B is an isometric view of a portion of an orifice plate electroformed on the mandrel in FIG. 3A.

The invention should not be construed to be limited to the use of the above orifice plate 16. A person skilled in the art would readily know that other configurations of orifice plates could be similarly electroformed to have a surface profile for mutual engagement of a corresponding barrier layer surface for the purpose of ensuring proper alignment. For example, FIG. 3A shows a plan view of a possible mandrel 114 that can be used to electroform another orifice plate 116 for use with this invention. FIG. 3B shows a portion of the electroformed orifice plate 116. This mandrel 114 has a first molding surface 118 and secondary molding surfaces 36. The first molding surface 118 is for molding a thicker border 122 similar to the earlier described embodiment and laterally extending projections 123. The secondary molding surfaces 119 are for molding an orifice area 124 and peripheral thinner areas 125. The border 122 defines a cavity 126 adjacent the orifice area 124. Holes in the molding surface 119 cause orifices 128 to be electroformed in the orifice area 124.

Figure 3C:
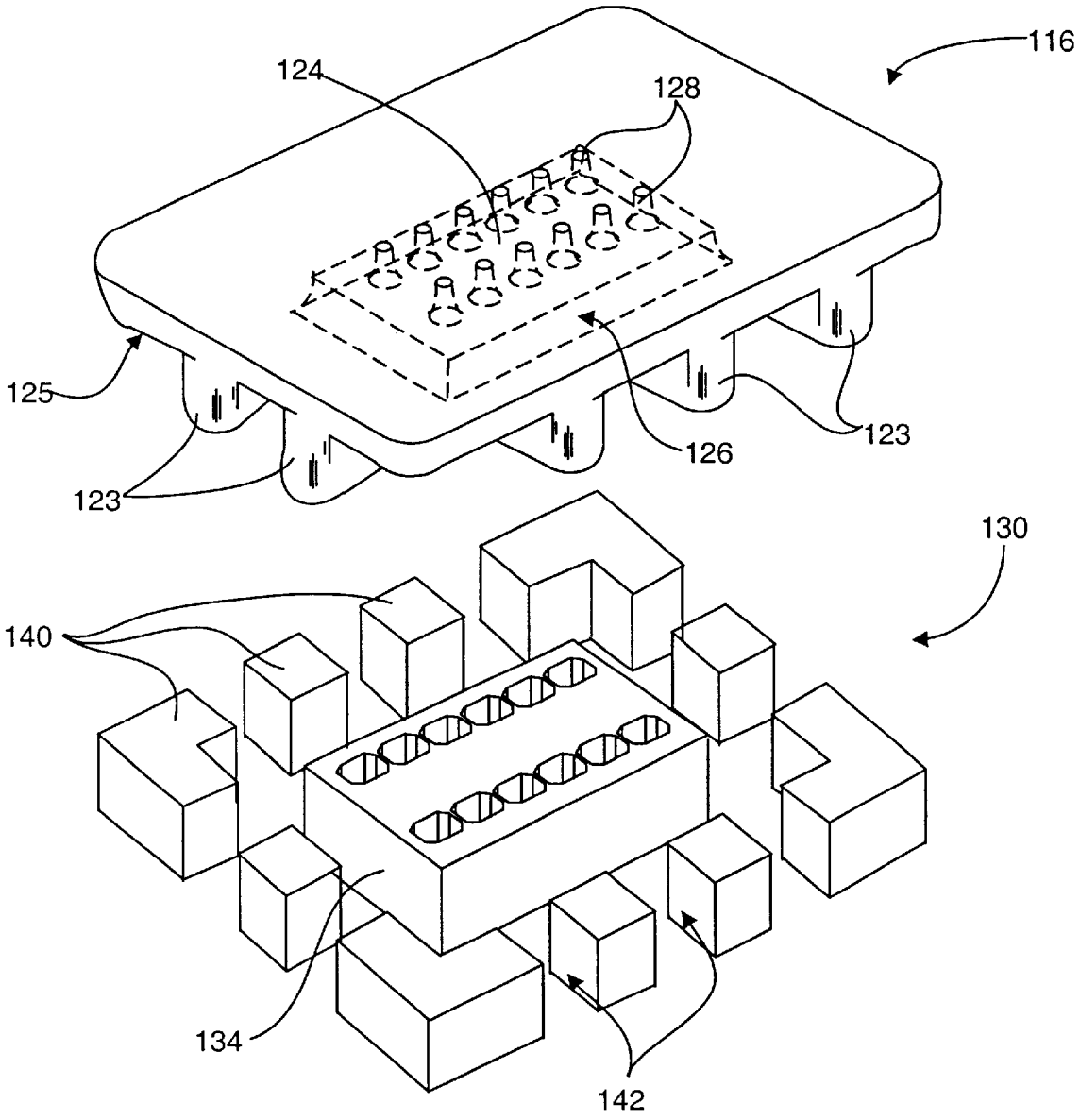
FIG. 3C is an isometric view of the electroformed orifice plate in FIG. 3B shown in a position for attachment to an appropriately shaped barrier layer of a printhead die.

FIG. 3C shows a barrier layer 130 that is developed to create a block 134 of barrier material as a locator and other peripheral locators 140 for meshing with the border 122 and the laterally extending projections 123 on the orifice plate 116. In this case, these locators 134,140 define channels 142 in the barrier layer 130 to receive the laterally extending projections 134 of the orifice plate 116. Such a configuration with its larger area of contact between the interlocking orifice plate 116 and the locators 134 has the added advantage of a stronger bond between the orifice plate 116 and the barrier layer 130. Such a configuration advantageously reduces delamination of the orifice plate from the barrier layer 130.

Also, it should not be construed that orifice plates for the present invention can only be electroformed, other methods for creating similar orifice plates are possible, and an example of which is by using a laser ablation process.

I claim:

1. A method for assembling a thermal ink jet printhead, comprising:

providing a non-uniformly thick electroformed orifice plate having:

a thin area;

a thick area that defines projections on the thin area; and orifices defined through the orifice plate;

providing a printhead die having:

transducers on a substrate, each transducer for matching to one of the orifices; and a barrier layer applied on the substrate and developed to define ink channels and ink chambers for delivering ink to the transducers and also to define at least a locator;

applying an amount of adhesive to one of the orifice plate and the barrier layer;

attaching the orifice plate to the printhead die so that the projections on the orifice plate mesh with the locator of the barrier layer to form a printhead and to substantially hold the orifice plate and the printhead die in place to align each orifice with a corresponding transducer; and baking the printhead to allow the orifice plate to be bonded to the printhead die.

2. A method according to claim 1, wherein the thin area is an orifice area on which the orifices are formed and the thick area forms a border around the thin area to define a cavity adjacent the thin orifice area; and wherein the barrier layer on the printhead die is developed to be a block that serves as the locator that substantially fits into the cavity of the orifice plate when the orifice plate is attached to the printhead die.

3. A method according to claim 2, wherein the border completely surrounds the thin orifice area of the orifice plate.

4. A method according to claim 2, wherein the thick area further includes a second plurality of projections laterally extending from the border and the barrier layer is developed to include peripheral locators that define ink channels therebetween and wherein the second plurality of projections mesh with the ink channels defined by the peripheral locators when the orifice plate is attached to the printhead die.

5. A printhead comprising:

a non-uniformly thick electroformed orifice plate having:

a thin area;

a thick area that defines projections from the thin area; and orifices defined through the orifice plate; and a printhead die having:

transducers on a substrate, each transducer for matching to one of the orifices; and a barrier layer on the substrate that is developed to define ink channels and ink chambers for delivering ink to the transducers and also to define a locator;

whereby when the orifice plate is attached to the printhead die, the projections on the orifice plate mesh with the locator on the barrier layer to substantially hold the orifice plate and the printhead die in place to align each orifice to a corresponding transducer.

6. A printhead according to claim 5, wherein the thin area is an orifice area on which orifices are formed and the thick area forms a border around the thin area to define a cavity adjacent the thin orifice area and wherein the barrier layer on the printhead die is developed to be a block that serves as the locator that substantially fits into the cavity of the orifice plate when the orifice plate is attached to the printhead die.

7. A printhead according to claim 6, wherein the border completely surrounds the thinner orifice area of the orifice plate.

8. A printhead according to claim 6, wherein the thick area further includes a second plurality of projections laterally extending from the border and the barrier layer is developed to include peripheral locators that define ink channels therebetween and wherein the second plurality of projections mesh with the ink channels defined by the peripheral locators when the orifice plate is attached to the printhead die.

9. A printhead comprising:

an electroformed orifice plate having orifices created therethrough, the electroformed orifice plate being substantially non-uniformly thick to define a first surface profile that includes projections;

a printhead die having transducers on a substrate, each transducer for matching to one of the orifices; and a barrier layer on the substrate that is developed to define ink channels and ink chambers for delivering ink to the transducers; the barrier layer further developed to create a second surface profile that defines locators;

whereby when the orifice plate is placed on the barrier layer, the projections and the locators mutually engage to substantially hold the orifice plate and the printhead die in place to align each orifice to a corresponding transducer.

* * * * *